US009006971B2

(12) United States Patent
Chua et al.

(10) Patent No.: US 9,006,971 B2
(45) Date of Patent: Apr. 14, 2015

(54) PLANAR HELIX SLOW-WAVE STRUCTURE WITH STRAIGHT-EDGE CONNECTIONS

(75) Inventors: Ciersiang Chua, Singapore (SG); Sheel Aditya, Singapore (SG); Zhongxiang Shen, Singapore (SG)

(73) Assignees: Cier Siang Chua, Singapore (SG); Sheel Aditya, Singapore (SG); Zhong Xiang Shen, Singapore (SG)

( * ) Notice: Subject to any disclaimer, the term of this patent is extended or adjusted under 35 U.S.C. 154(b) by 40 days.

(21) Appl. No.: 13/261,370

(22) PCT Filed: Apr. 14, 2010

(86) PCT No.: PCT/SG2010/000152

§ 371 (c)(1),
(2), (4) Date: Jul. 19, 2012

(87) PCT Pub. No.: WO2011/096890

PCT Pub. Date: Aug. 11, 2011

(65) Prior Publication Data

US 2012/0286657 A1 Nov. 15, 2012

(30) Foreign Application Priority Data

Feb. 4, 2010 (SG) ..... 201000786

(51) Int. Cl.
*H01J 25/34* (2006.01)
*H01J 23/24* (2006.01)

(52) U.S. Cl.
CPC *H01J 25/34* (2013.01); *H01J 23/24* (2013.01)

(58) Field of Classification Search
USPC ..... 315/3.5; 333/157, 162, 22 R
See application file for complete search history.

(56) References Cited

U.S. PATENT DOCUMENTS

| | | | | |
|---|---|---|---|---|
| 2,853,642 | A * | 9/1958 | Birdsall et al. | 315/3.5 |
| 2,888,600 | A * | 5/1959 | Rich | 315/5.53 |
| 3,289,031 | A * | 11/1966 | Yukio et al. | 315/3.5 |
| 3,819,976 | A * | 6/1974 | Chilton et al. | 315/3.5 |
| 7,193,485 | B2 * | 3/2007 | Dayton, Jr. | 331/177 V |
| 7,504,039 | B2 * | 3/2009 | Sadwick et al. | 216/48 |
| 8,179,048 | B2 * | 5/2012 | Dayton et al. | 315/39.3 |
| 8,549,740 | B1 * | 10/2013 | Hwu et al. | 29/831 |

* cited by examiner

*Primary Examiner* — Douglas W Owens
*Assistant Examiner* — Srinivas Sathiraju

(57) ABSTRACT

A planar helix slow-wave structure with straight edge connections where the structure consists of two arrays of thin, parallel, conductors printed on top and bottom faces of a low-loss dielectric material or substrate, the conductors in the arrays printed on the top and bottom surfaces being inclined at different but symmetric pitch angles on the surface of the planar surface, the conjunction ends of the conductors on the top and bottom faces being connected by vertical conductors with circular rings with a diameter greater than the diameter of the vertical conductors to ensure proper connections between them, and a vacuum tunnel inside the planar helix structure.

15 Claims, 5 Drawing Sheets

*Perspective view of the planar helix with straight-edge connections.*

*Perspective view of the planar helix with straight-edge connections.*

*Enlarged view of the planar helix with straight-edge connections.*

*Cross section view of the planar helix with straight-edge connections.*

*Top view of the proposed structure integrated with coplanar waveguide (CPW) feed.*

*Simulated phase velocity for the embodiment with coplanar ground planes on the top face of the printed circuit board and without coplanar ground planes.*

*Simulated on-axis interaction impedance for the embodiment with coplanar ground planes on the top face of the printed circuit board and without coplanar ground planes.*

*Measured and simulated S parameters of the embodiment with coplanar ground planes on the top face of the printed circuit board integrated with 50Ω CPW feed.*

*Cross section view of the fabricated embodiment.*

*Evidence of traveling wave amplification at 5GHz → Input and output signals vs. time.*

PLANAR HELIX SLOW-WAVE STRUCTURE WITH STRAIGHT-EDGE CONNECTIONS

FIELD OF THE INVENTION

The present invention relates to the field of slow-wave structures and in particular discloses a new planar helix slow-wave structure and its input-output connections capable of broadband operation.

BACKGROUND OF THE INVENTION

A slow-wave structure, with phase velocity substantially slower than the speed of light, typically finds application in Traveling-Wave Tube (TWT). The TWT is an amplifier of microwave signals and it provides the largest bandwidth among all high power vacuum electronic devices. Two primary components of a TWT are an electron beam (e-beam) and a travelling electromagnetic (EM) wave. The EM wave is guided by a slow-wave structure. The slow-wave structure slows down the EM wave, ensuring 'velocity synchronism' between the electrons in the e-beam and the EM wave.

The most common slow-wave structure is the circular helix because of its un-matched capability for strong electron-wave interaction over large bandwidths. However, the circular helix is not a planar structure and it is not amenable to fabrication using printed-circuit or micro-fabrication techniques. Printed-circuit techniques are important for miniaturization as well as low-cost mass-production. Miniaturized TWTs can have widespread applications in communications, radar, spectroscopy etc. Moreover, since device dimensions scale inversely with frequency, at high frequencies the fabrication of the electron gun and slow-wave structure using conventional manufacturing technology becomes very difficult. Therefore micro-fabrication techniques are almost mandatory at high frequencies of operation. Further, an advantage of a planar slow-wave structure is the possibility of use of sheet geometry for electron beam. As compared to the round beam geometry, sheet beam geometry offers advantages of higher beam current capacity, decreased beam voltage and increased bandwidth.

SUMMARY OF THE PRESENT INVENTION

The primary object of the present invention is to disclose a broadband planar helix slow-wave structure and its broadband input-output connections.

The present invention consists of arrays of thin, parallel, conductors printed on top and bottom faces of a low-loss dielectric material or a substrate. The conductors in the top and bottom arrays are inclined at different but symmetric pitch angles. The conjunction ends of the conductors in the top and bottom arrays are connected by vertical conductors. Planar helix structure is formed by the conductors in the arrays and the vertical conductors at the conjunction end. The vertical—or straight-edge connections—are simple and can be realized using printed-circuit or micro-fabrication techniques.

The slowing down effect in the present structure can be controlled by varying the pitch angle of the conductors in the top and bottom arrays, as well as by selecting the dielectric constant of the low-loss dielectric material.

The top face of the low-loss dielectric material can incorporate a pair of ground planes at some distance from the planar helix structure for dispersion shaping purpose. In a similar manner, the bottom face of the low-loss dielectric material can incorporate a pair of ground planes at some distance from the planar helix structure. Alternatively or additionally, the structure can incorporate a pair of ground planes at some height above and below the planar helix structure.

A vacuum tunnel with a rectangular cross-section smaller than the planar helix can be located centrally. Such a vacuum tunnel can accommodate a sheet electron beam for application in TWTs. The material surrounding the vacuum tunnel can form a vacuum envelope for the e-beam. Alternatively, the sheet beam can also be located just above (or just below), i.e., in close proximity with, the top or bottom arrays of conductors.

The present slow-wave structure can be integrated with input-output connections (also called feed), e.g., a broadband coplanar waveguide (CPW) feed. Broadband matching is achieved by tapering the CPW sections at the input and output of the helical structure. The input-output CPW sections can be straight or can include a right angle bend for different applications.

One possible method of fabricating the present slow-wave structure is to use multiple layers of low-loss dielectric materials. The arrays of conductors on the top and bottom faces can be fabricated on two separate printed-circuit boards using milling or photolithographic process. The two printed-circuit boards with arrays of conductors on the top and bottom faces can sandwich two or more un-metalized layers of low-loss dielectric material to form a rectangular tunnel within the planar helix structure. The vertical conductors on the conjunction ends of the conductors in the top and bottom arrays can be realized, for example, using vias or plated-through hole technology. The layers of low-loss dielectric materials may have the same dielectric constant or may have different dielectric constants.

A planar helical structure, as disclosed in U.S. patent application Ser. No. 09/750,796, using through holes for electric connections at the conjunction end of microstrip sections, appears similar to the structure proposed by us. However, that structure does not have input-output CPW sections, ground planes, or a vacuum tunnel. Moreover, the application proposed in U.S. patent application Ser. No. 09/750,796 is as an antenna.

The usefulness of the present invention will be clear after reading the detailed description of the preferred embodiment with reference to the attached drawings.

BRIEF DESCRIPTION OF THE DRAWINGS

Notwithstanding any other forms which may fall within the scope of the present invention, preferred forms of the invention will now be described with reference to the accompanying drawings in which.

DESCRIPTION OF THE PREFERRED AND OTHER EMBODIMENTS

Figure 1:
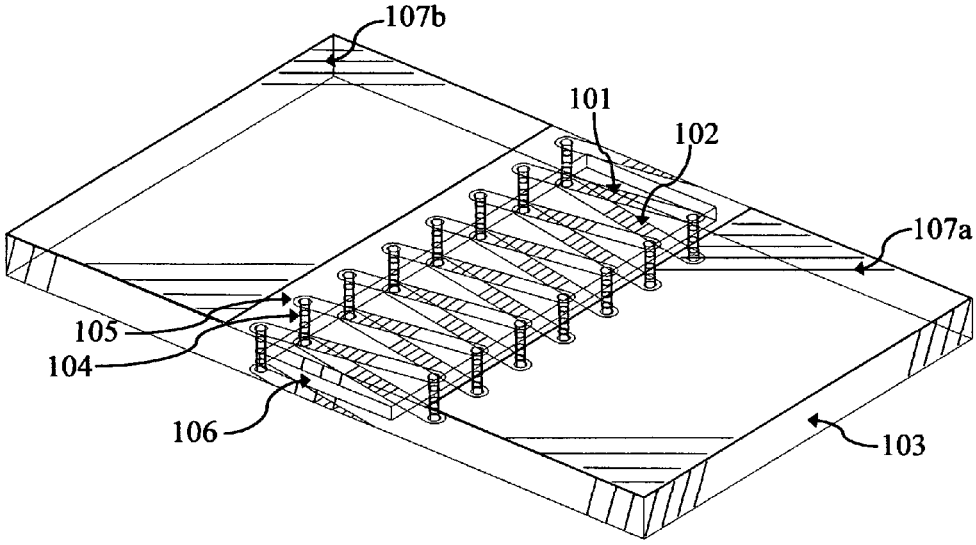
FIG. 1 is a perspective view of the present invention showing the planar helix with straight-edge connections in the presence of a dielectric substrate, vacuum tunnel and coplanar ground planes.

The preferred embodiment of the planar helix slow-wave structure with straight-edge connections, as shown in FIG. 1, consists of arrays of thin, parallel, conductors 101 and 102 printed on top and bottom faces, respectively, of a low-loss dielectric material 103. The conjunction ends of the conductors 101 and 102 are connected by vertical conductors 104. Circular rings 105, with diameter greater than the diameter of vertical conductors 104, help to ensure connections between 101, 102 and 104. The planar helix structure is formed by of the combination of multiple conductors 101, 102, 104 and 105. A vacuum tunnel 106, with a rectangular cross section smaller than that of the planar helix, is located centrally within the planar helix. For TWT applications, this vacuum tunnel can accommodate a sheet electron beam. Two coplanar ground planes 107*a* and 107*b* are located on the top face of the low-loss dielectric material 103 with a small separation from the edges of the circular rings 105.

Figure 2:
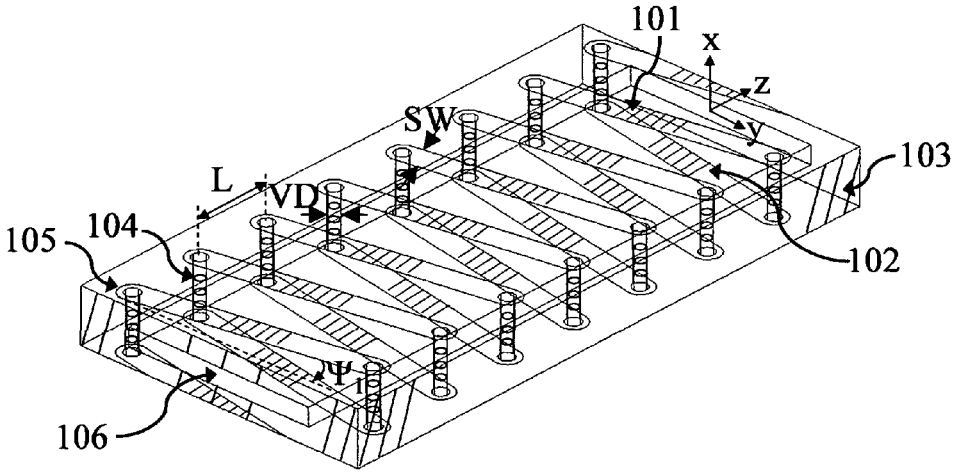
FIG. 2 is an enlarged view of FIG. 1 showing the planar helix in the presence of a vacuum tunnel only.
Figure 3:
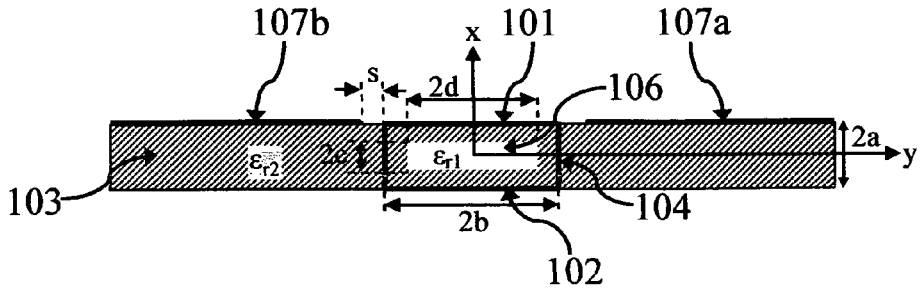
FIG. 3 is a cross-section view of FIG. 1.

As indicated in an enlarged view of the planar helix structure in FIG. 2, the conductors 101 on the top face are oriented at an angle $\Psi_1$ with respect to the y-direction and the conductors 102 on the bottom face are oriented at an angle $-\Psi_1$ with respect to the y-direction. L is the period of the planar helix; SW is the width of conductors 101 and 102 and VD is the diameter of the vertical conductors 104. FIG. 3 shows the rectangular cross-section of the structure in the xy-plane. The cross-section dimensions of the planar helix and the vacuum tunnel are (2*a*, 2*b*) and (2*c*, 2*d*), respectively. The period L is related to the cross section dimensions and pitch angle as $$L=4b\tan(\Psi_1) \quad (1)$$

The separation between the ground planes 107*a* and 107*b* on the top face and the edges of the circular rings 105 is s. The vacuum in the tunnel has a dielectric constant $\in_{r1}=1$. The dielectric material 103 surrounding the vacuum tunnel has a dielectric constant $\in_{r2}$. A ceramic type of dielectric material is preferable for the high temperature and vacuum environment in a TWT; the ceramic material can also act as a vacuum envelope.

Figure 4:
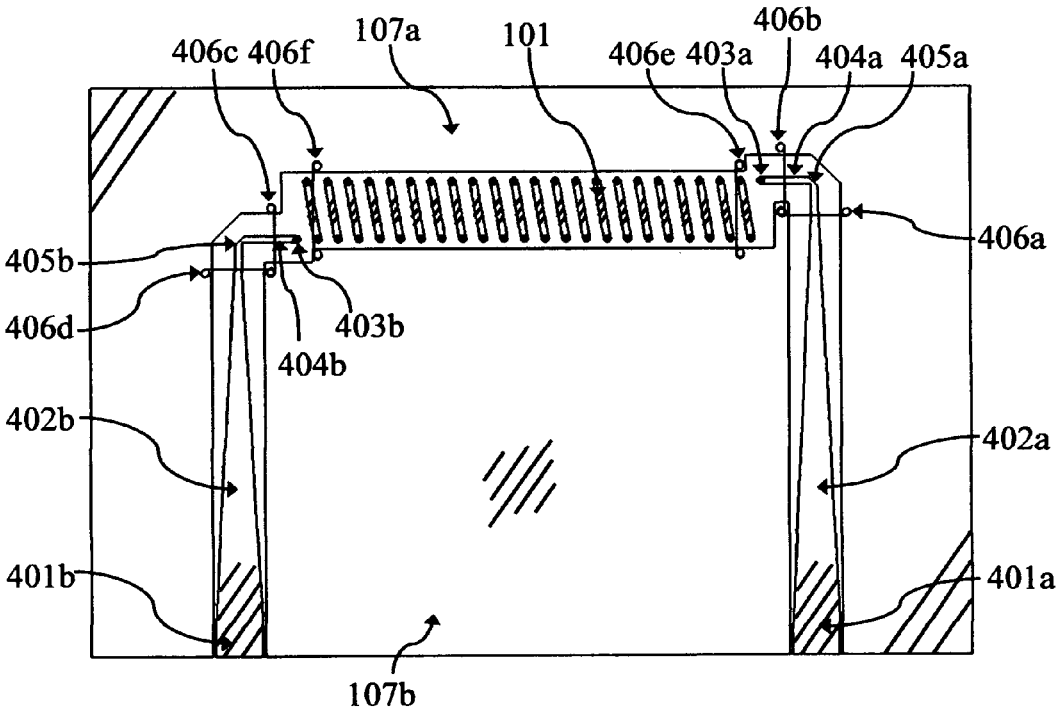
FIG. 4 is a top view of the planar helix with straight-edge connections, in the presence of a vacuum tunnel and coplanar ground planes, integrated with coplanar waveguide feed for both input and output. The coplanar waveguide feed also incorporates a right angle bend at both ends.

FIG. 4 shows the top-view of the planar helix with straight-edge connections, in the presence of coplanar ground planes, integrated with coplanar waveguide (CPW) ports 401*a* and 401*b* with a characteristic impedance of 50Ω. Tapered CPW sections, 402*a* and 402*b*, are incorporated between the 50Ω CPW ports and the input and output, 403*a* and 403*b*, of the planar helix. Wideband impedance matching can be achieved by optimizing the length of the CPW tapered sections 402*a* and 402*b* and the impedance at the end of the tapered sections, 404*a* and 404*b*, respectively. In order to provide CPW ports on the same side of the structure and to accommodate the electron gun and collector in TWT applications, the CPW portions incorporate a right angle bend, 405*a* and 405*b*. Air bridges 406*a*, 406*b*, 406*c* and 406*d*, 406*e* and 406*f* are added at the CPW right angle bends as well as at the input and output of the planar helix, to ensure that the ground planes 107*a* and 107*b* are at the same potential.

Figure 5A:
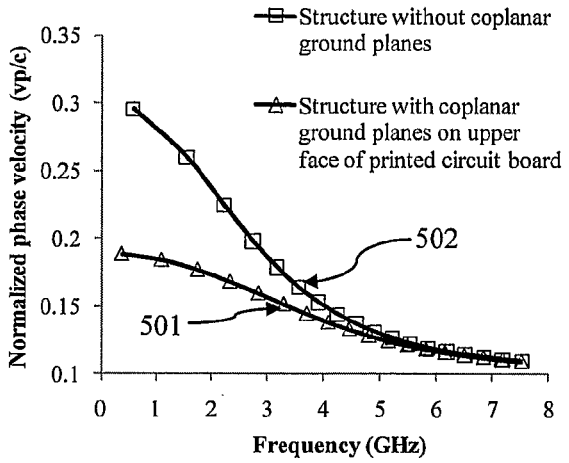
FIG. 5A shows the simulated phase velocity of the preferred embodiment, with and without coplanar ground planes.
Figure 5B:
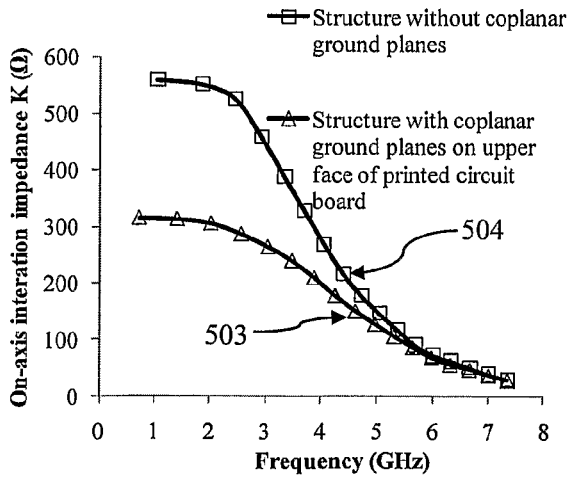
FIG. 5B shows the simulated on-axis interaction impedance of the preferred embodiment, with and without coplanar ground planes.

One period of the embodiment of the planar helix in the presence of vacuum tunnel has been simulated, with and without coplanar ground planes, using CST Microwave Studio Eigenmode Solver. The embodiment dimensions are a=0.75 mm, b=3 mm, c=0.25 mm, d=2 mm, $\Psi_1=10^0$, SW=0.7 mm, VD=0.36 mm, $\in_{r1}=1$, $\in_{r2}=3.02$ and circular ring diameter of 0.71 mm. For the embodiment with coplanar ground planes, s is taken as 0.5 mm. FIG. 5A shows a comparison of the normalized phase velocity ($v_p/c$) between the embodiment with (501) and without (502) coplanar ground planes. The curve 501 shows that a reduced phase velocity variation can be obtained by putting coplanar ground planes on the top face of the low-loss dielectric material. The variation of the phase velocity can be further reduced by reducing s or by introducing similar coplanar ground planes at the bottom face also. The phase velocity and operating bandwidth of the embodiment is affected by the dimensions of the planar helix structure, size of the vacuum tunnel, as well as the material of the low-loss dielectric material. FIG. 5B shows the simulated on-axis interaction impedance of the embodiment with (503) and without (504) coplanar ground planes. Although the variation of phase velocity can be reduced by the coplanar ground planes, these also reduce the on-axis interaction impedance, especially at lower frequencies, as shown in 503. A lower on-axis interaction impedance may result in a lower gain in the TWT applications.

Figure 6:
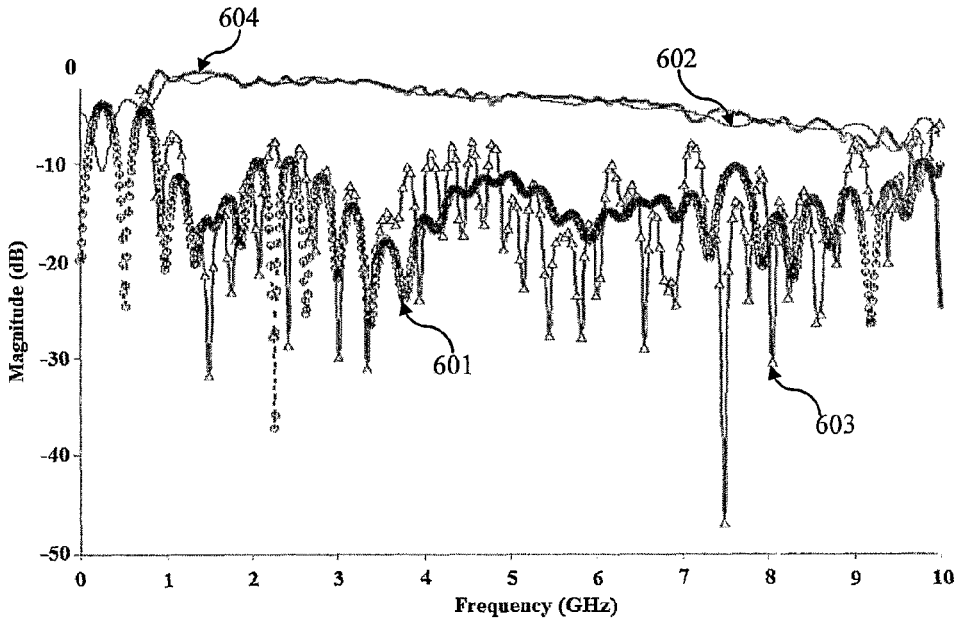
FIG. 6 shows the simulated and measured S-parameters of the preferred embodiment of FIG. 4.

The embodiment with coplanar ground planes on the top face of the low-loss dielectric material, integrated with CPW feed as shown in FIG. 4, has been designed using CST Microwave Studio. Printed-circuit board Rogers RO3203, with thickness 1.5 mm and dielectric constant 3.02, was selected for this design. The simulated S parameters, taking into account the loss in the dielectric and conducting materials, are shown in FIG. 6. In this configuration—10 dB $S_{11}$ bandwidth, shown in the curve 601, covers the frequency range from 1 GHz to around 9.5 GHz—which is almost a decade of bandwidth (1:9.5). The $S_{21}$, 602, drops significantly at high frequencies. This is mainly due to low conductivity of the vertical conductors 104 on the conjunction ends of the conductors 101 and 102.

Figure 7:
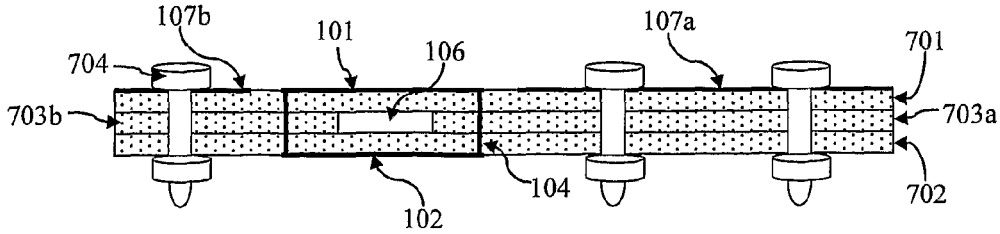
FIG. 7 shows the cross-section view of the fabricated embodiment of the planar helix with straight-edge connections.

As shown in FIG. 7, an embodiment of the planar helix can be fabricated using 4 pieces of low-loss dielectric material 701, 702, 703*a* and 703*b*. The conductors 101 and 102 on the top and bottom faces are fabricated on two separate printed-circuit boards, 701 and 702, using milling or photolithographic process. 701 and 702 sandwich two un-metalized pieces of the low-loss dielectric material, 703*a* and 703*b*, to form a rectangular tunnel within the planar helix structure. The vertical conductors, 104, on the conjunction ends of the conductors in the top and bottom array can be realized, for example, using vias or plated-through hole technology. The pieces 701, 702, 703*a* and 703*b* can be secured together by using screw and nut sets 704. The low-loss dielectric material, 701, 702, 703*a* and 703*b*, may have the same dielectric constant, as shown in FIG. 3, or may have different dielectric constants.

Following the configuration in FIG. 7, the embodiment shown in FIG. 4 has been fabricated, using Rogers RO3203 dielectric substrate with a thickness of 0.5 mm for 701, 702, 703*a* and 703*b*. Three layers of 0.5 mm thick dielectric substrate are stacked together to produce an overall 1.5 mm high (a=0.75 mm) planar helix structure. The pieces 703*a* and 703*b* are separated by 4 mm (d==2 mm). FIG. 6 includes the measured S parameters 603 and 604 of the fabricated structure. The measured results, 603 and 604, generally match well the simulated ones, 601 and 602.

Figure 8:
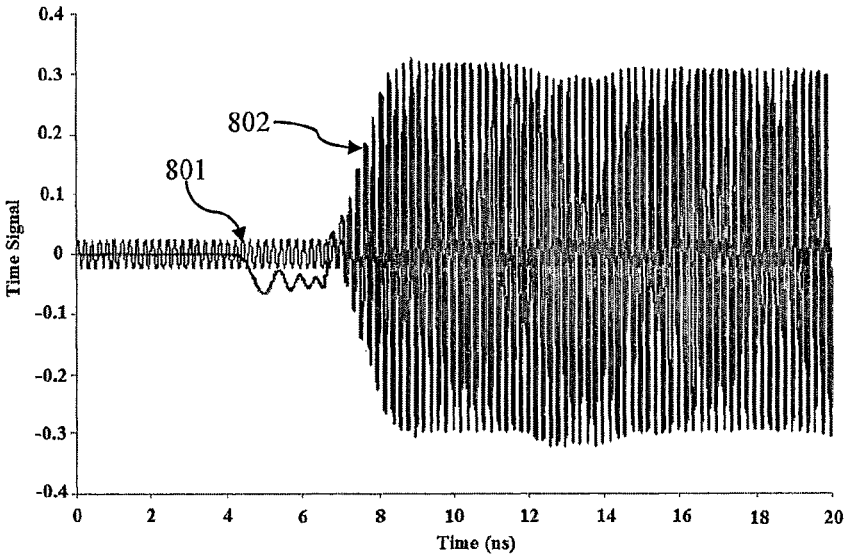
FIG. 8 shows the simulated traveling wave amplification of the preferred embodiment of FIG. 4 at 5 GHz.

The small signal simulation of the electron beam and EM wave interaction for the embodiment shown in FIG. 4 has been performed using CST Particle Studio Particle-In-Cell solver. A sheet electron beams with a cross-section half that of the vacuum tunnel 106 is used in the simulations. Following the curve 501 in FIG. 5A, the normalized phase velocity of the EM wave is 0.126 at 5 GHz. Therefore, the beam voltage is set to 4070 V, corresponding to a beam normalized velocity of 0.127, which is slightly higher than that for the EM wave. 5 mA of beam current and 100 periods of the planar helix are assumed. FIG. 8 shows the simulated input and output RF signals, 801 and 802, respectively, as a function of time. A 5 GHz sinusoidal RF signal, 801, with input power of 0.5 mW is injected into the input CPW port. The amplification of the input signal can be seen clearly in 802. From 801, the input wave amplitude is 0.02236 (square root of 0.5 mW), and from 802, the output wave amplitude is 0.32 after 9 ns. Therefore, the small signal gain is 23.1 dB.

Only a few implementations are disclosed here. However, it would be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

Some Relevant References

R. J. Barker et al, Eds., 'Modern microwave and millimeter-wave power electronics', IEEE Press, USA, 2005.

V. Srivastava, "THz vacuum microelectronic devices," International Symposium on Vacuum Science and Technology (IVS2007).

B. E. Carlsten, S. J. Russell, L. M. Earley, E L. Krawczyk, J. M. Potter, P. Ferguson, and S. Humphries, "Technology development for a mm-wave sheet-beam TWT," IEEE Trans. on Plasma Science, vol. 33, pp. 85-93, February 2005.

C. F. Fu, Y. Y. Wei, W. X. Wang, and Y. B. Gong, "Dispersion characteristics of a rectangular helix slow-wave structure," IEEE Trans. Electron Devices. vol. 55, no. 12, December 2008.

C. Chua, S. Aditya, and Z. Shen, "Effective dielectric-constant method for a planar helix with straight-edge connections," IEEE EDL, vol. 30, no. 11, 2009.

I-Fonf Chen, "Planar helix antenna with two frequencies", United States patents, patent filed Jan. 2, 2001, application Ser. No.: 09/750,796.

E. G Chaffee, "Planar-shielded meander slow-wave structure", United States patents, patent filed Oct. 13,1971, Appl. no.: 188893.

What is claimed is what is described and illustrated, including:

1. A planar helix slow-wave structure with straight-edge connections, the structure comprising:

two arrays of thin, parallel, conductors printed on top and bottom faces of a low-loss dielectric material or substrate;

the conductors in the arrays printed on the top and bottom faces inclined at different but symmetric pitch angles;

conjunction ends of the conductors on the top and bottom faces connected by vertical conductors;

circular rings with a diameter greater than a diameter of the vertical conductors to ensure proper connections between the vertical conductors and the conductors on the top and bottom faces; and a vacuum tunnel inside the planar helix structure.

2. The structure as claimed in claim 1, wherein each of the two arrays of conductors is printed on a different layer of the low-loss dielectric material.

3. The structure as claimed in claim 2 further comprising at least one layer of the low-loss dielectric material between the two faces of low-loss dielectric material on which each of the two arrays is printed.

4. The structure as claimed in claim 2 further comprising at least one layer of the low-loss dielectric material outside the two faces of low-loss dielectric material on which each of the two arrays is printed.

5. The structure as claimed in claim 1 further comprising coplanar ground planes on the top and bottom faces of the low-loss dielectric material with lateral separation from edges of the circular rings.

6. The structure as claimed in claim 1 further comprising a pair of ground planes above and below the planar helix structure.

7. The structure as claimed in claim 1 further comprising a coplanar waveguide feed, wherein the coplanar waveguide feed comprises:

coplanar waveguide ports of arbitrary impedance for input/output of a high frequency signal;

coplanar waveguide sections of arbitrary impedance at the input/output ends of the planar helix structure;

tapered coplanar waveguide sections joining the coplanar waveguide ports and the coplanar waveguide sections at the input/output ends of the planar helix structure;

coplanar waveguide right angle bends near the input/output ends of the planar helix structure; and air bridges at the coplanar waveguide right angle bends and at the input/output ends of the planar helix structure.

8. The structure as claimed in claim 1 further comprising a microstrip or waveguide feed.

9. The feed as claimed in claim 7 further comprising bends to accommodate an electron gun and a collector.

10. A planar helix structure, the structure comprising:

first horizontal conductors printed on a top face of low-loss dielectric material;

second horizontal conductors printed on a bottom face of the low-loss dielectric material;

vertical conductors for coupling conjunction ends of the first horizontal conductors and the second horizontal conductors;

circular rings with a diameter greater than a diameter of the vertical conductors for connecting the vertical conductors to the first and the second horizontal conductors; and a vacuum tunnel inside the planar helix structure.

11. The structure of claim 10, wherein the low-loss dielectric material comprises silicon.

12. The structure of claim 10, wherein the first and the second horizontal conductors are printed on different layers of the low-loss dielectric material, and wherein the different layers comprise a plurality of layers of low-loss dielectric material between them.

13. A planar helix structure, the structure comprising:

a plurality of arrays of horizontal conductors printed on respective layers of low-loss dielectric material;

vertical conductors coupled to conjuction ends of the arrays of horizontal conductors;

circular rings for connecting the vertical conductors to the horizontal conductors; and a vacuum tunnel inside the planar helix structure.

14. The structure of claim 13, wherein vertical conductors are situated on low-loss dielectric material.

15. The structure of claim 13 further comprising a shielding enclosure for the planar helix structure.

* * * * *